US008434987B2

(12) United States Patent
Szoke et al.

(10) Patent No.: US 8,434,987 B2
(45) Date of Patent: May 7, 2013

(54) BINDING MACHINE

(75) Inventors: Ezra Szoke, Inverness, IL (US); Milos Coric, Lincolnshire, IL (US)

(73) Assignee: ACCO Brands Corporation, Lincolnshire, IL (US)

( * ) Notice: Subject to any disclaimer, the term of this patent is extended or adjusted under 35 U.S.C. 154(b) by 607 days.

(21) Appl. No.: 12/646,008

(22) Filed: Dec. 23, 2009

(65) Prior Publication Data

US 2011/0150605 A1 Jun. 23, 2011

(51) Int. Cl.
*B42B 5/10* (2006.01)
*B42B 9/00* (2006.01)
*B26F 1/14* (2006.01)

(52) U.S. Cl.
USPC ..... 412/38; 412/39; 412/40; 412/16; 83/687; 83/691

(58) Field of Classification Search ..... 412/6, 7, 412/16, 38–40; 83/549–551, 687, 691
See application file for complete search history.

(56) References Cited

U.S. PATENT DOCUMENTS 3,656,394 A * 4/1972 McCutcheon ..... 83/689
4,079,647 A 3/1978 Elder et al.
4,607,993 A 8/1986 Scharer
4,613,266 A 9/1986 Scharer
4,645,399 A 2/1987 Scharer
4,763,552 A 8/1988 Wagner
4,820,099 A 4/1989 Battisti
4,900,211 A 2/1990 Vercillo
4,902,183 A 2/1990 Vercillo et al.

(Continued)

FOREIGN PATENT DOCUMENTS

DE 19947256 4/2001
DE 202005012237 1/2006
DE 102008003419 7/2009

OTHER PUBLICATIONS

Photos and CAD Image of ACCO/GBC MagnaPunch Binding Machine Punch Pins, with Statement of Relevance, available at least as early as Dec. 22, 2008, 6 pages, admitted prior art.

(Continued)

*Primary Examiner* — Dana Ross
*Assistant Examiner* — Kyle Grabowski
(74) *Attorney, Agent, or Firm* — Michael Best & Friedrich LLP

(57) ABSTRACT

A binding machine includes a body, an actuator coupled with the body, and a punch mechanism housed in the body for punching a stack of sheets upon actuation of the actuator. The punch mechanism includes a plate including a plurality of punch pins. The punch pins are configured to punch through the stack of sheets during a punch stroke, the punch stroke defining a force profile. A portion of the force profile defined from a first drop in force to a last peak force before a final decrease has no more than a 15 percent change in force relative to a normalized maximum force of the force profile.

21 Claims, 12 Drawing Sheets

U.S. PATENT DOCUMENTS

| | | | | |
|---|---|---|---|---|
| 5,044,242 | A * | 9/1991 | Chiang | 83/549 |
| 5,051,050 | A | 9/1991 | Scharer | |
| 5,090,859 | A | 2/1992 | Nanos et al. | |
| 5,419,668 | A | 5/1995 | Ballist | |
| 5,615,986 | A | 4/1997 | Cox | |
| 5,669,747 | A | 9/1997 | Scharer | |
| 5,730,038 | A | 3/1998 | Evans et al. | |
| 5,740,712 | A | 4/1998 | Watkins et al. | |
| 5,785,479 | A | 7/1998 | Battisti et al. | |
| 5,934,340 | A | 8/1999 | Anthony, III et al. | |
| 5,971,689 | A | 10/1999 | Scharer et al. | |
| 6,074,151 | A * | 6/2000 | Pas | 412/38 |
| 6,079,924 | A | 6/2000 | Chiang | |
| 6,527,016 | B2 | 3/2003 | Todaro | |
| 6,773,216 | B2 | 8/2004 | Crudo et al. | |
| 7,168,903 | B2 | 1/2007 | Hild | |
| 2002/0108482 | A1 | 8/2002 | Negishi | |
| 2008/0066600 | A1 | 3/2008 | Mita | |
| 2009/0136324 | A1 * | 5/2009 | Aoki et al. | 412/36 |

OTHER PUBLICATIONS

Image of GBC CombBind C340 Binding Machine Punch Blade, with Statement of Relevance, available at least as early as Dec. 22, 2008, 2 pages, admitted prior art.

Photos of ACCO/GBC MP 2500 ix Binding Machine Punch Assembly, with Statement of Relevance, available at least as early as Dec. 22, 2008, 8 pages, admitted prior art.

International Search Report and Written Opinion from the International Search Authority for PCT/US2010/060641, Aug. 2, 2011, 16 pages.

Invitation to Pay Additional Fees and, Where Applicable, Protest Fee received from the International Searching Authority for International Application No. PCT/US2010/060641 dated Mar. 30, 2011, 7 pages.

* cited by examiner

BINDING MACHINE

BACKGROUND

The present invention relates to binding machines.

Binding machines for binding stacks of sheets are known. The machines include a punching mechanism for punching the stack of sheets to be bound, and a binding apparatus for binding the punched stack of sheets. Various types of binding elements can be used with the binding apparatus, including elements typically referred to as "comb" binding elements.

FIG. 1 illustrates a prior art GBC COMBBIND C340 binding machine 10 having a manually-actuated punching device. A user rotates the lever or handle 14 to punch the holes in the stack of sheets to be bound, which is positioned in a slot 18. The binding machine 10 includes a punch plate having thereon a plurality of punch pins (e.g., 19 or 21 pins) that pierce the stack of sheets as the punch plate is moved by operation of the handle 14.

Prior art binding machines, including the illustrated binding machine 10, typically require a large input of force by the user to punch the stack of sheets. In addition to requiring a large force input, the user will experience a rough and uneven motion of the handle 14 along the punch stroke, as the punching force changes significantly during the punching stroke. This is due to the variation in force required to pierce the stack of sheets as the different punch pins strike and pierce the stack of sheets.

FIG. 2 is a graph illustrating the punch force versus displacement for the punch plate (including all of the punch pins), which was mathematically determined based on test data collected for a single punch pin of the prior art binding machine 10. Alternatively, the graph can be obtained using test data collected for the entire punch plate (i.e., test data taken for the punch plate with all of punch pins). This graph can be referred to as the punch force profile for the punch plate. The force value is not normalized, but merely includes a generic scale for reference. The noticeable peaks and valleys are evidence of the changes in punch force occurring during the punch stroke as various punch pins strike, pierce, and pass through the stack of sheets. As the punch pins on the punch plate vary in length, different pins strike and pierce the stack of sheets at different times during the punch stroke. These peaks and valleys shown in the graph explain the rough and uneven movement of the handle 14 experienced by the user during the punch stroke. At one location at about the midpoint of the punch stroke where the force trend line is generally flat, designated as portion 22 in FIG. 2, a percentage change in force from a peak 26 to a valley 30 is about 29 percent. At other locations along the punch stroke, the percentage change in force between peaks and valleys is significantly higher. It is believed that this graph in FIG. 2 is representative of prior art binding machines, which require significant peak force input, but also have a very rough and uneven punch stroke, the force and vibration of which are transmitted through the handle 14 to the user to provide a very disjointed and rough operational feel.

SUMMARY

The present invention provides an improved binding machine punch mechanism that not only lowers the peak force required to complete the punch stroke, but also results in a punch stroke with a smooth force profile. The smooth force profile results in a more ergonomic feel for a user operating a manual binding machine. Additionally, for motor-actuated binding machines, the smooth force profile during the punch stroke can offer advantages as well.

In one aspect, the invention provides a binding machine including a body, an actuator coupled with the body, and a punch mechanism housed in the body for punching a stack of sheets upon actuation of the actuator. The punch mechanism includes a plate including a plurality of punch pins. The punch pins are configured to punch through the stack of sheets during a punch stroke, the punch stroke defining a force profile. A portion of the force profile defined from a first drop in force to a last peak force before a final decrease has no more than a 15 percent change in force relative to a normalized maximum force of the force profile.

In another aspect, the invention provides a binding machine including a body, an actuator coupled with the body, and a punch mechanism housed in the body for punching a stack of sheets upon actuation of the actuator. The punch mechanism includes a plate having a plurality of punch pins configured to punch through the stack of sheets during a punch stroke. The binding machine further includes a shaft coupled with the actuator such that movement of the actuator causes rotation of the shaft, and at least one cam mounted on the shaft for rotation therewith. The cam is coupled with the plate to drive the plate in a punching direction and includes a cam profile that dictates displacement of the plate in the punching direction relative to rotation of the shaft.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

Figure 1:
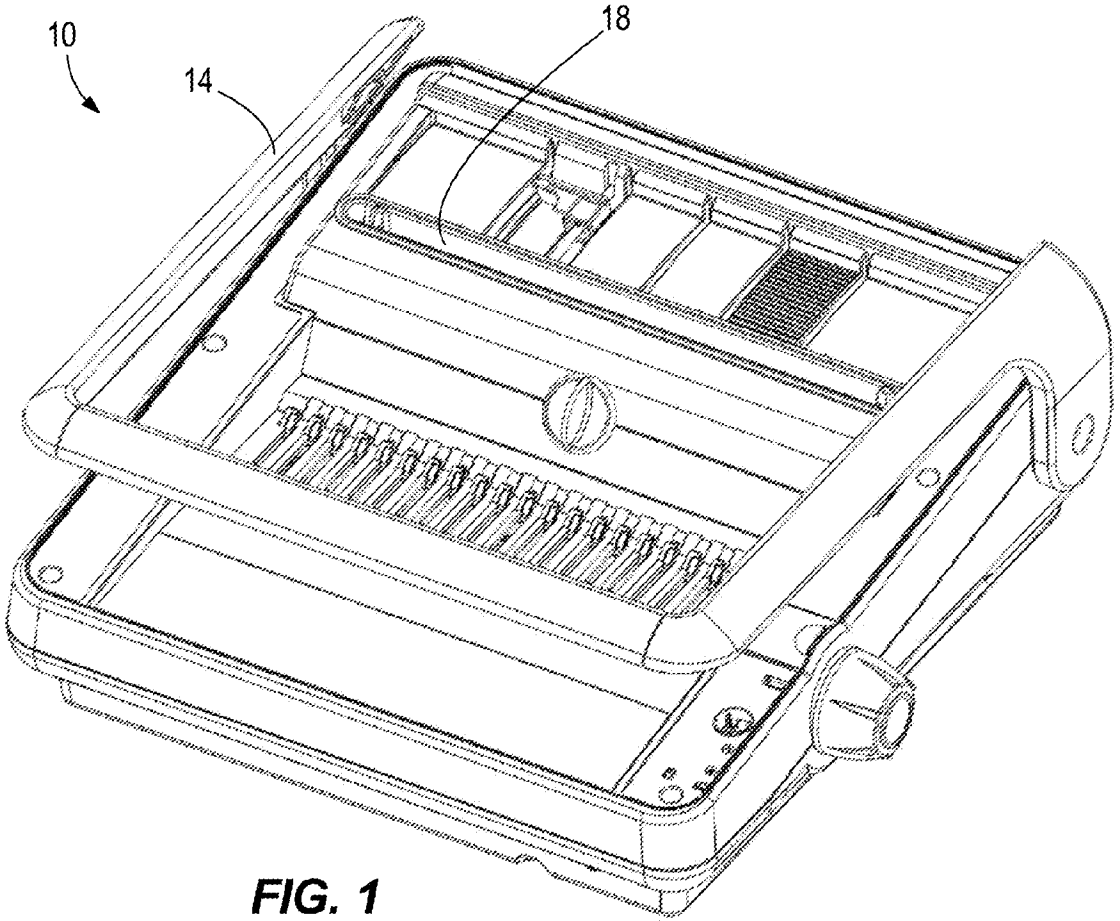
FIG. 1 PRIOR ART
FIG. 1 is a perspective view of a prior art binding machine.
Figure 2:
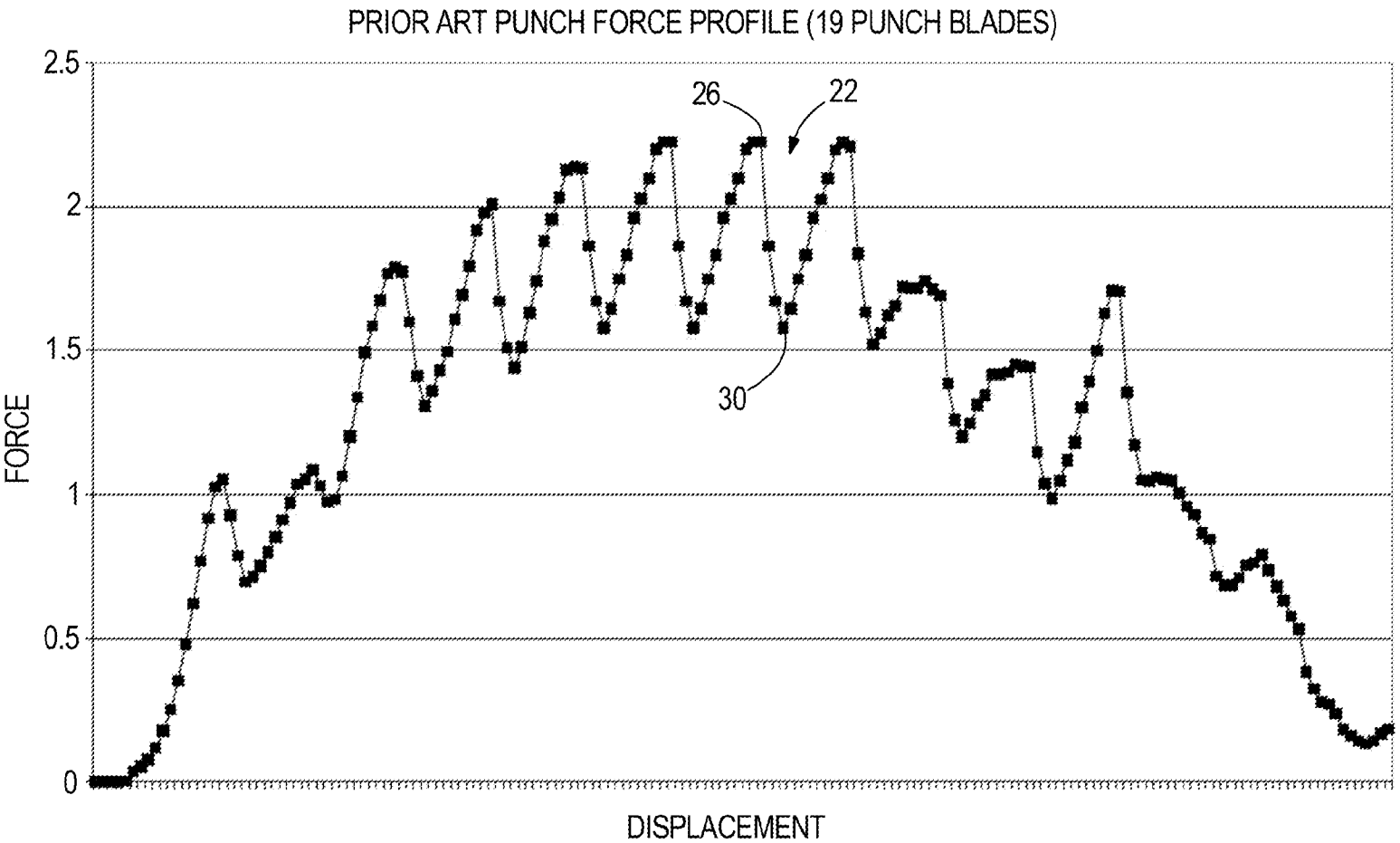
FIG. 2 is graph of punch force versus displacement for the prior art binding machine of FIG. 1.
Figure 3:
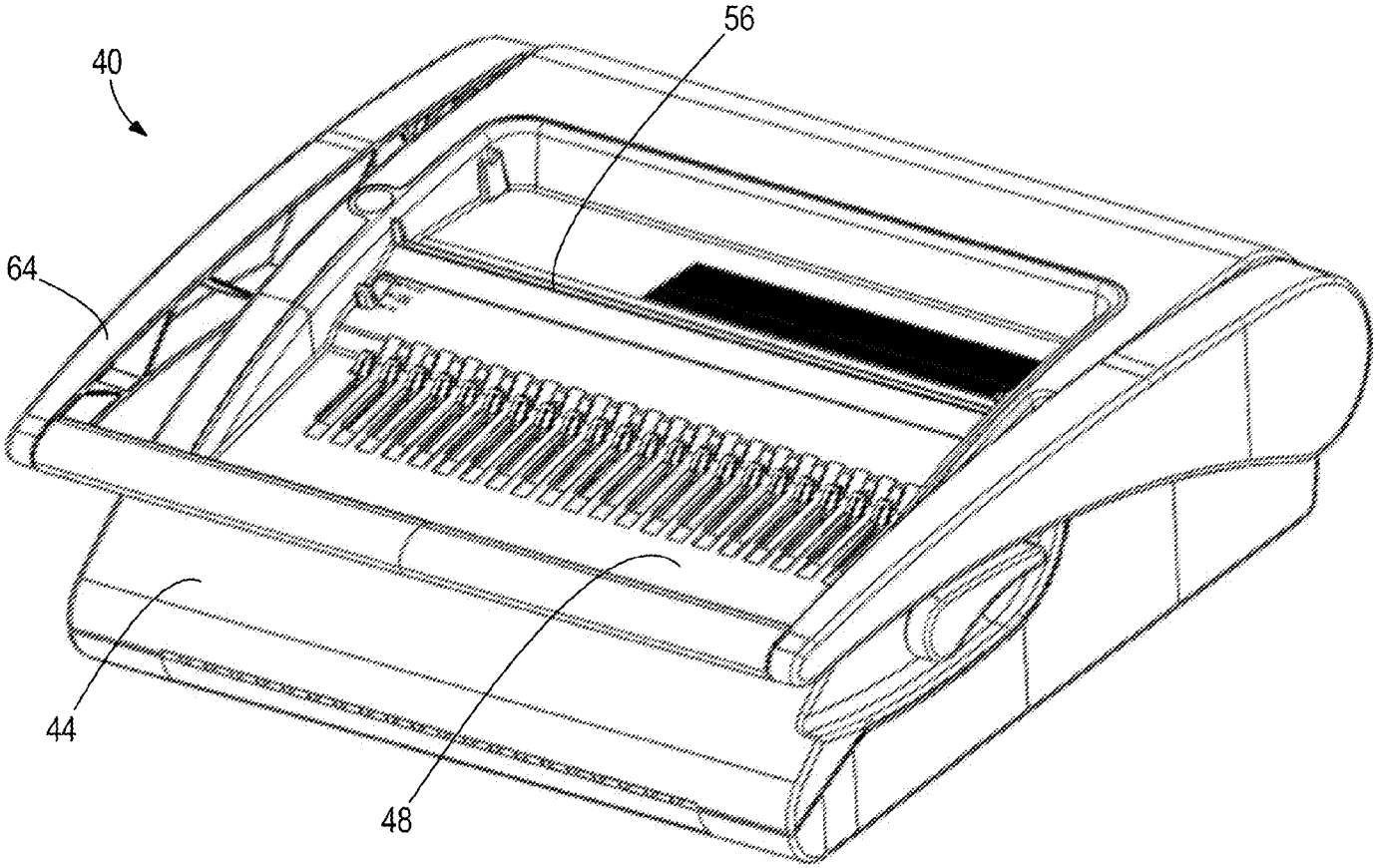
FIG. 3 is a perspective view of a binding machine having a punching mechanism embodying the present invention.

FIG. 3 illustrates a binding machine 40 according to the present invention. The binding machine 40 includes a body 44 having thereon a working deck 48 where a user performs the various operations for binding a stack of sheets. A cover (not shown) can be coupled to the body 44 and can be selectively opened (as shown in FIG. 3) for using the binding machine 40, or closed to conceal the working deck 48. A slot or aperture 56 in the working deck 48 receives sheets to be punched.

Figure 4:
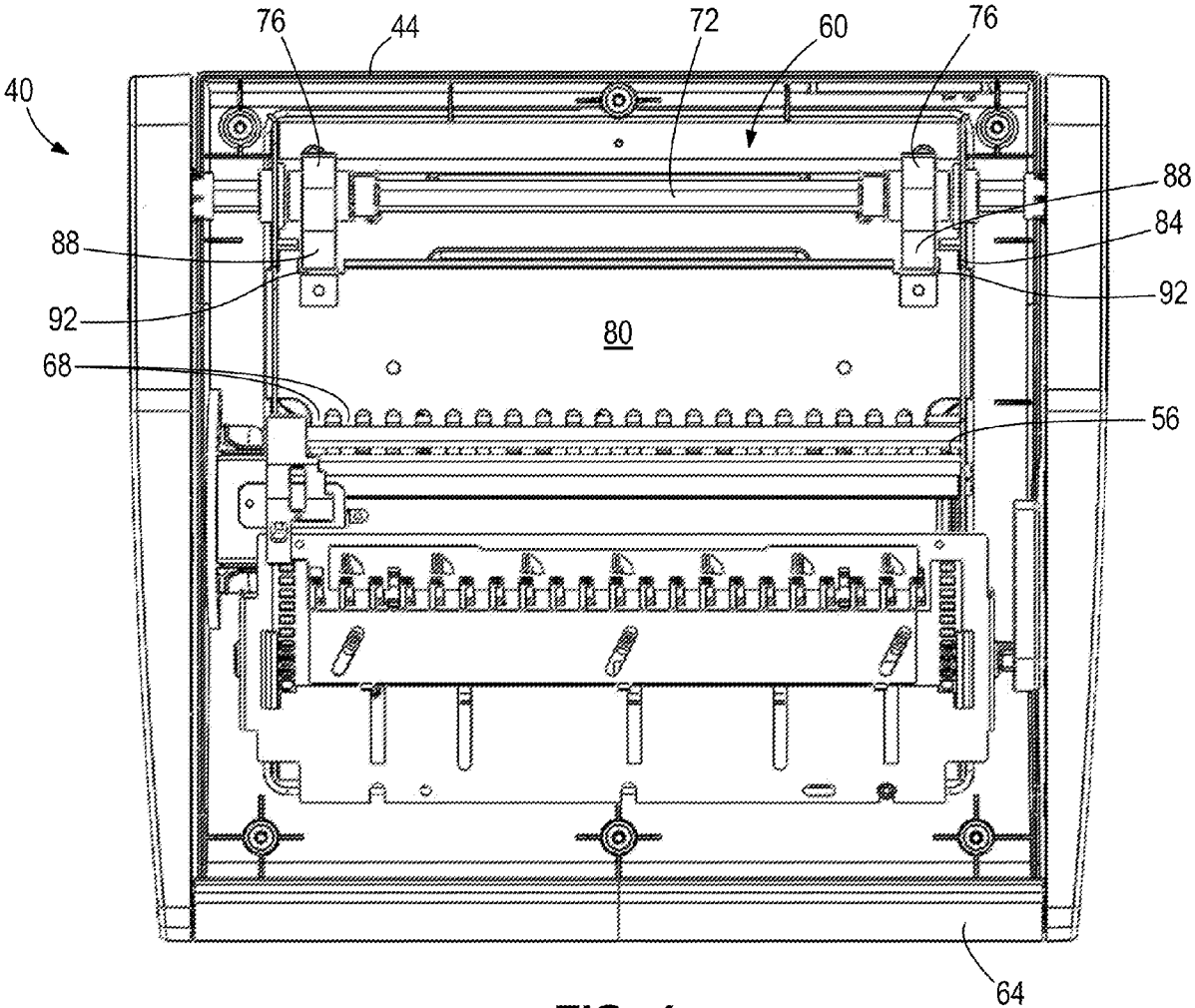
FIG. 4 is a top view of the binding machine of FIG. 3 shown with portions removed to expose the punching mechanism.

FIG. 4 illustrates a punching mechanism, designated generally as 60, of the binding machine 40. The punching mechanism 60 is housed within the body 44 and is operable to punch sheets to be bound. The punching mechanism 60 is actuated by an actuating member such as lever or handle 64. The user pulls the lever 64 to drive the punch elements, sometimes referred to as punch pins or teeth 68 (see FIG. 9), through the sheets in the slot 56. If the stack of sheets to be punched is too thick to be placed in the slot 56 at one time, the user can divide the stack and perform multiple punching operations until all of the sheets to be bound have been punched. In other embodiments, an automatic, push-button actuator can replace the manual lever 64, for example, if the punching mechanism 60 is motor-driven.

As best seen in FIG. 4, the lever 64 is coupled to a shaft 72 such that actuation or movement (e.g., rotation) of the lever 64 by a user will cause rotation of the shaft 72. The illustrated shaft has a hexagonal cross-section and is received in mating hexagonally-shaped apertures in the lever 64 to provide the force transmission. At least one, and in the illustrated embodiment, two cams 76 are coupled to the shaft 72 for rotation therewith. The cams 76 can also be formed with a hexagonally-shaped aperture or bore for receiving the shaft 72 for force transmission. Of course, other constructions for transmitting force from the lever 64 to the shaft 72 and to the cams 76 can be substituted.

The cams 76 are positioned on the shaft 72 to engage and drive a punch plate 80 containing the punch pins 68. The cams 76 therefore transmit the user's input force to the punch plate 80. The illustrated punch plate 80 is supported by a frame 84 for sliding movement in a punching direction (i.e., away from the shaft 72 in FIG. 4) to punch the stack of sheets during a punch stroke, and in direction opposite to the punching direction (i.e., a return direction toward the shaft 72 in FIG. 4) to return the punch plate to the ready position during a return stroke. The punch plate 80 is constrained by the frame 84 so that it can move substantially only in the punching direction and the return direction, which lie in the same plane.

Figure 5:
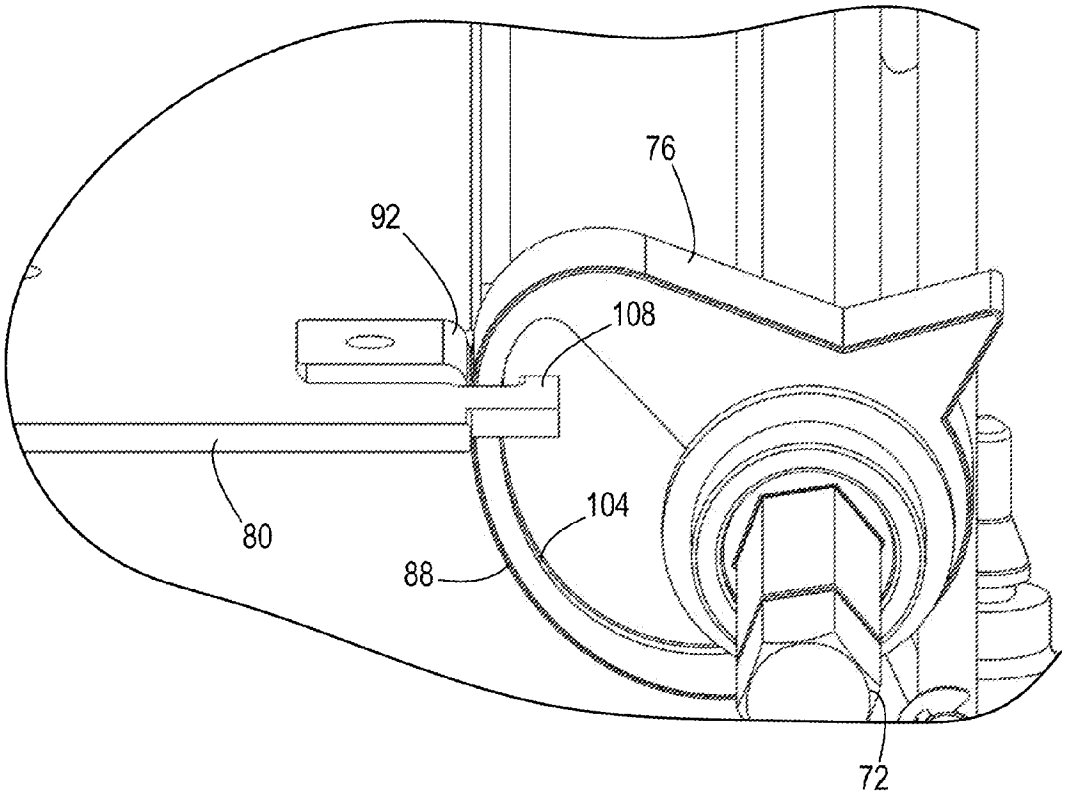
FIG. 5 is a partial perspective view of the punching mechanism.

The illustrated cams 76 engage or interface with the punch plate 80 to drive movement of the punch plate 80 both in the punching direction (i.e., the punch stroke) and in the return direction (i.e., the return stroke). However, in other embodiments, the cams 76 might only drive the punch stroke, while other means (e.g., a spring return) could be provided to move the punch plate 80 in the return stroke. As best seen in FIGS. 4-8, each cam 76 includes a first cam profile 88 on its outer surface for driving the punch plate 80 in the punching direction through the punch stroke. As seen in FIGS. 4 and 5, a non-metallic material 92 can be positioned between the cam 76 and the punch plate 80 to prevent metal-to-metal contact at the interface between the first cam profile 88 and the punch plate 80. The non-metallic material 92 can be a low-friction plastic material to help reduce the sliding friction at the interface between the cam 76 and the punch plate 80.

Figure 6:
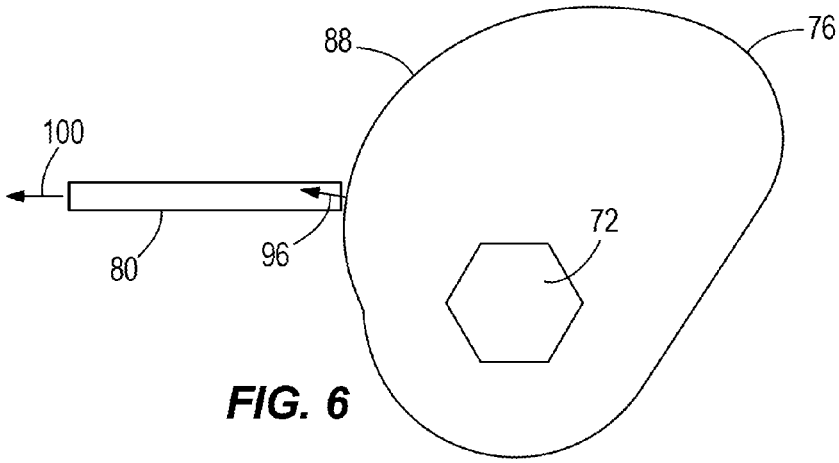
FIG. 6 is a schematic side view of the cam and punch plate interface shown at the start of the punch stroke.
Figure 7:
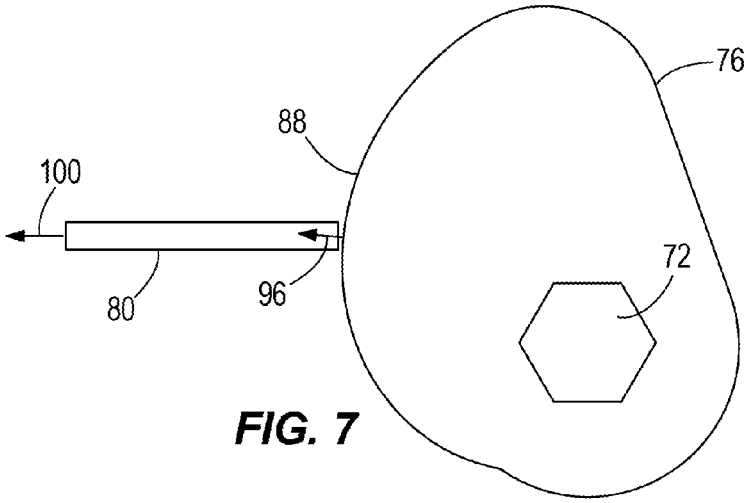
FIG. 7 is a schematic side view of the cam and punch plate interface shown at the midpoint of the punch stroke.
Figure 8:
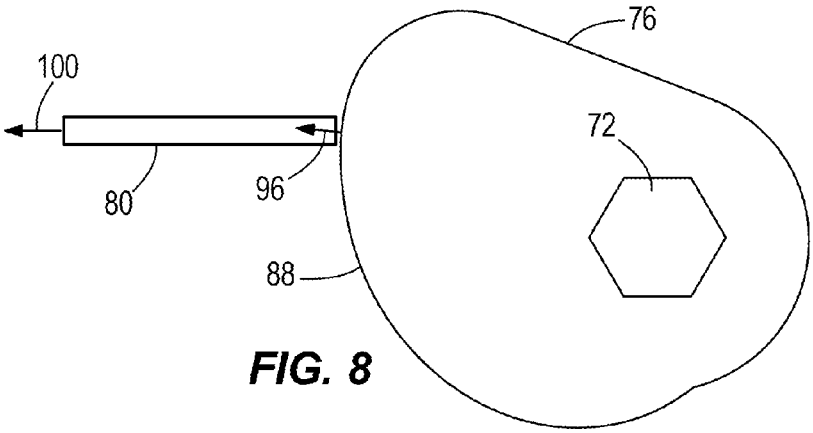
FIG. 8 is a schematic side view of the cam and punch plate interface shown at the end of the punch stroke.

The first cam profile 88 is designed to dictate the displacement and rate of displacement of the punch plate 80 in the punching direction relative to the rotation of the shaft 72. Furthermore, the first cam profile 88 is designed such that the force applied by the first cam profile 88 to the punch plate 80, illustrated as the force vector 96 in FIGS. 6-8, is as close to the punching direction as possible. In the illustrated embodiment, the force vector 96 is always within 5 degrees of the punching direction (indicated by the arrow 100 in FIGS. 6-8 and 9) during the punch stroke. While there is technically another force vector (not shown) oriented upwardly at ninety degrees from the vector 96 due to friction at the interface, the presence of the low-friction material 92 minimizes the effect of such friction force, making it insubstantial. FIGS. 6-8 show the start position (see FIG. 6), the middle position (see FIG. 7), and the end position (see FIG. 8) of the punch stroke.

Compared to prior art binding machines that do not use cams to drive the punch plate, but instead use gears, swing arms, rack-and-pinion, or other arrangements, the cams 76 of the present invention help to lower the peak punching force that must be input by the user to punch sheets, by using the first cam profile 88 to maximize mechanical advantage. Furthermore, and as will be discussed in greater detail below, the first cam profile 88 can also be used to some extent to help provide a smooth feel to the user by allowing for a customizable displacement rate of the punch plate 80 in the punching direction. This, in combination with the punch force profile of the punch plate 80 (discussed below), makes the user's operation of the lever 64 much more smooth and even-feeling than the operation of prior art binding machines.

The illustrated cams 76 also drive the return stroke of the punch plate 80 as the user lifts the lever 64. As best seen in FIG. 5, each cam 76 includes a second cam profile 104 formed on a side surface of the cam 76. The punch plate 80 includes spaced-apart follower portions 108 (see also FIG. 9) that engage respective second cam profiles 104 of the cams 76. As the user lifts the lever 64, the engagement of the second cam profiles 104 with the respective follower portions 108 operates to pull the punch plate 80 for the return stroke back to the ready position. As mentioned above, other means for driving the return stroke can be substituted.

Figure 5A:
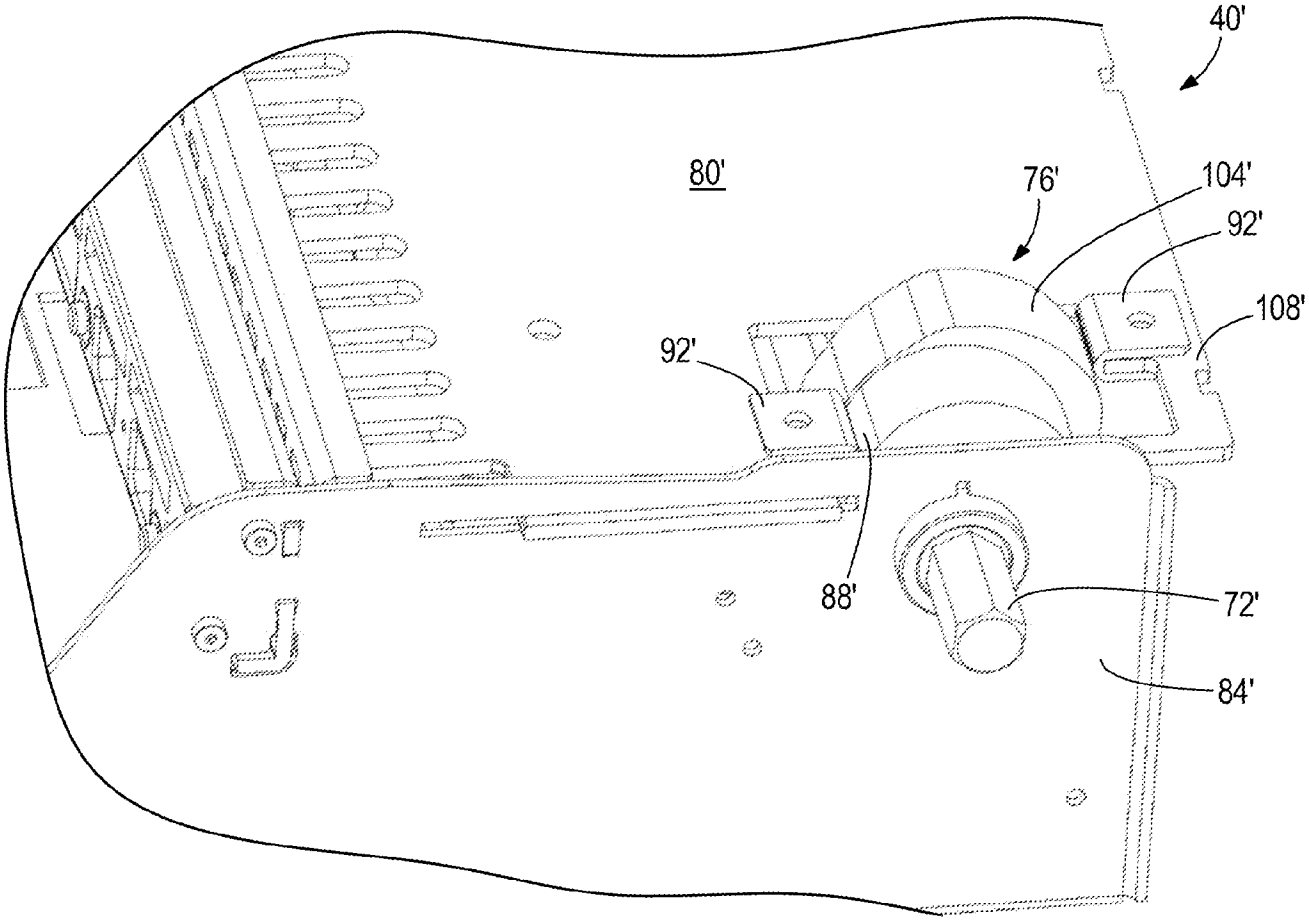
FIG. 5*a* is a partial perspective view of the punching mechanism having an alternate cam arrangement.

For example, as seen in FIG. 5*a*, in a motorized version of the punch 40', a cam 76' may have a first cam profile 88' for driving the punch stroke over about 270 degrees of rotation of the cam 76', while a second cam profile 104' may drive the return stroke over about the remaining 90 degrees of rotation of the cam 76'. The cam 76' rotates through a single direction of rotation, as driven by the shaft 72', to complete both the punch stroke and the return stroke. However, the shaft rotational direction can be reversed for jam-clearing in the event of a jam. The punch plate 80' is slightly modified from the punch plate 80 to include the modified follower portions 108' positioned on the opposite side of shaft 72' from the follower portions 108 shown in FIG. 5. The follower portions 108' are also provided with the low-friction material 92' to eliminate metal-to-metal contact. Other like parts have been labeled with the same reference numbers plus prime (').

The punch plate 80, and more specifically the punch pins 68 of the punch plate 80, are designed and oriented to reduce the peak force required for punching as well as to provide a smooth punch force profile during the punch stroke. Several features contribute to these outcomes.

Figure 9:
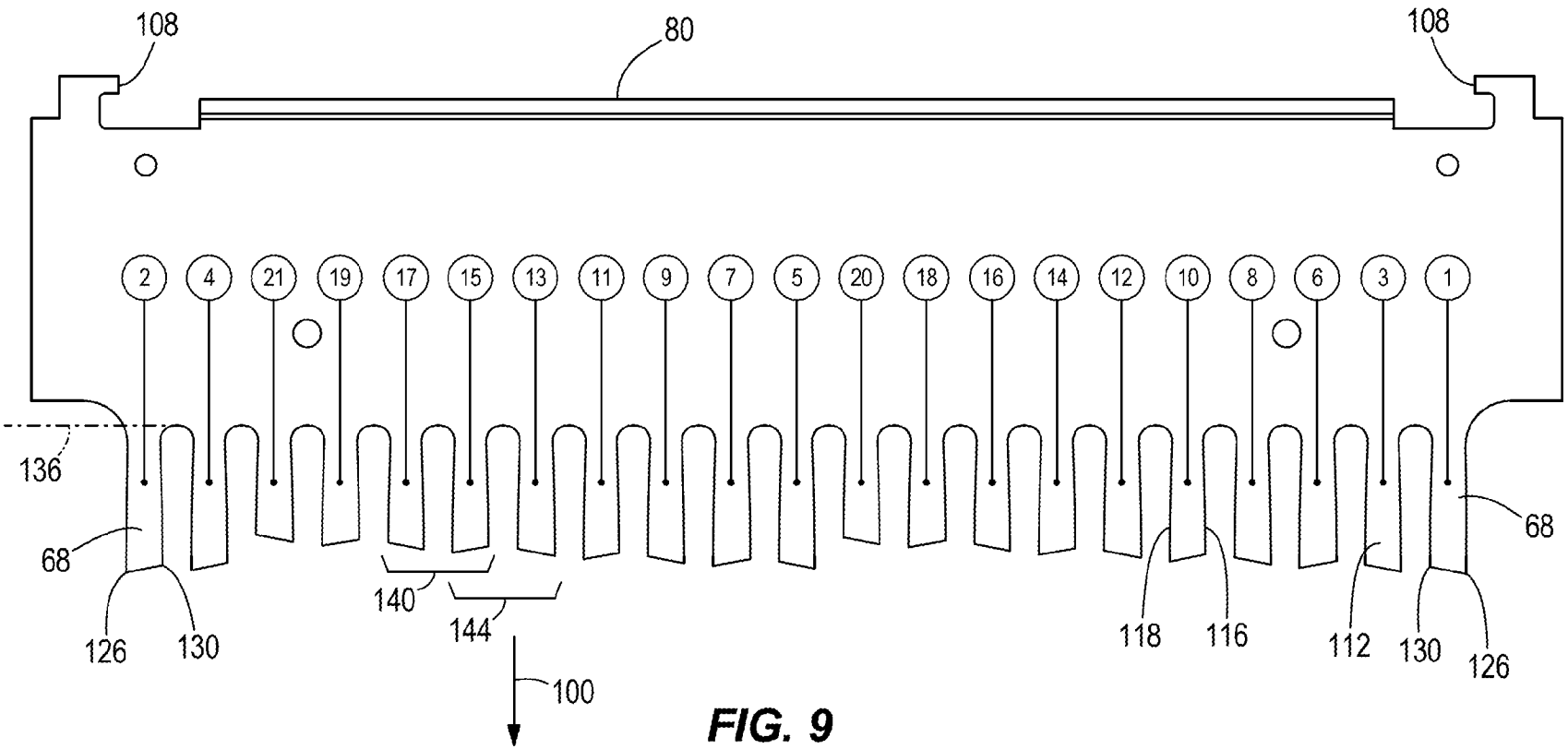
FIG. 9 is a top view of the punch plate.
Figure 10:
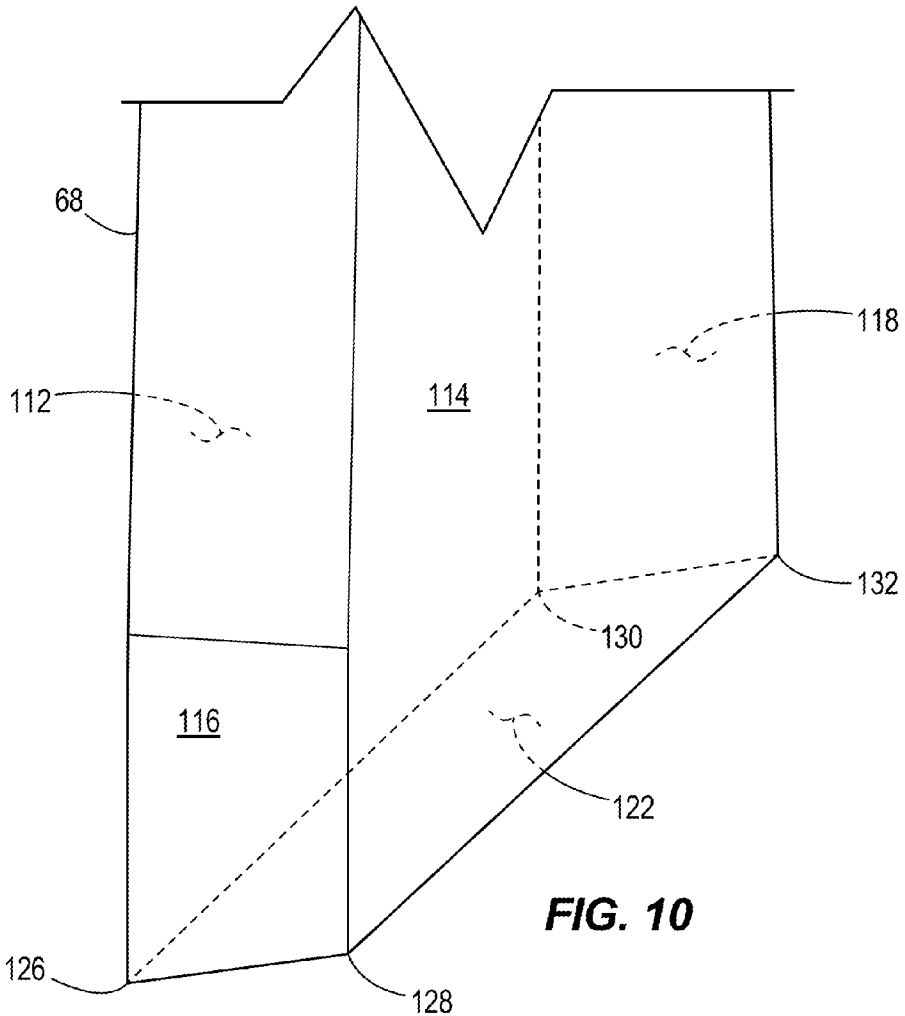
FIG. 10 is a partial perspective view of a distal end of one of the punch pins.

Referring to FIGS. 9 and 10, the illustrated punch pins 68 are integrally formed as part of the punch plate 80, but alternatively could be separate parts coupled to the punch plate 80. As best shown in FIG. 10, each pin 68 is formed with a pair of parallel sides 112, 114, which in the illustrated embodiment, lie in the same plane as the top or bottom surfaces of the punch plate 80. Each pin 68 further includes two additional sides 116, 118, that may or may not be parallel to one another.

Each tooth 68 further includes a distal end that defines a planar surface 122 that is oblique to the parallel sides 112, 114, and in the illustrated embodiment, is also oblique to the sides 116 and 118. The planar surface 122 is therefore formed with a double angle, meaning that it is angled as it extends laterally from the side 116 to the side 118 (see FIG. 9), but that it is also angled as it extends transversely from the side 112 to the side 114 (see FIG. 10). In other words, the planar surface 122 has four corners, with a distal corner 126 being the corner that is the furthest in the punching direction away from a fixed location on the punch plate 80, such as a common root location 136 (see FIG. 9) of the pins 68. A second corner 128 is the second furthest away from the common root location 136 in the punching direction, a third corner 130 is the third furthest away from the common root location 136 in the punching direction, and a fourth corner 132 is the closest to the common root location 136 in the punching direction. With this arrangement, each corner 126, 128, 130, 132 lies in a different plane perpendicular to the punching direction such that no two corners 126, 128, 130, 132 initially engage the stack of sheets at the same time during punching. This reduces the force required for each pin 68 to pierce the stack of sheets by providing more of a shearing or cutting action as the distal end of the pin 68 enters and passes through the stack of sheets.

The distal end configuration of the pins 68 helps to reduce the peak punching force required and also contributes to the smooth punch force profile that will be further described below. The shearing or cutting action achieved by the double angle configuration of the planar surface 122 helps to smooth the punch force profile as each individual pin 68 strikes and cuts through the stack of sheets.

Referring now to FIG. 9, the particular sizing and arrangement of the pins 68 also contributes significantly to reduced peak punching force and the smooth punch force profile. The illustrated punch plate 80 includes twenty-one punch pins 68. Twenty-one punch pins 68 is a common number for binding machines designed to be used with stacks of A4 paper (e.g., machines designed for use in Europe). However, the punch plate 80 can be modified to a nineteen punch pin 68 design for use with stacks of 8½×11 inch paper (e.g., machines designed for use in the United States) by simply removing the outermost punch pin 68 on each side of the punch plate 80 (the punch pins designated as pins 1 and 2 in FIG. 9).

In the embodiment of the punch plate 80 shown in FIG. 9, each pin 68 has a different length as measured from the common root location 136 to the respective distal corner 126. This means that during a punch stroke, only a single distal corner 126 of the nineteen or twenty-one pins 68 (depending upon the machine 40) will initially contact the stack of sheets at a time as the punch plate 80 is displaced in the punching direction. By staggering the distal corners 126 in this manner, the punching force is distributed very evenly and smoothly during the punch stroke. In the illustrated embodiment, the difference in pin length is not a fixed offset value yielding a common stagger. Instead, some optimization is used to arrive at the non-uniform, staggered lengths. The pin numbering sequence in FIG. 9 designates the length of the pins and illustrates one possible sequence of the pins 68, with pin number 1 being the longest pin and pin number 21 being the shortest pin. Note that the four longest pins 68 are the two outer pins on each end of the punch plate 80 and the fifth longest pin is the central pin. The specific pattern set forth in FIG. 9 has been found to yield a low peak punching force and a smooth punch force profile with a flat trend line, but other patterns can also be substituted.

Yet another feature of the punch pin arrangement that contributes to the low peak punching force and the smooth punch force profile is the arrangement of the distal corners of adjacent punch pins 68. Still referring to FIG. 9, the punch pins 68 are arranged on the punch plate 80 such that a first pair 140 of adjacent punch pins 68 has the respective distal corners 126 adjacent to one another, while a second pair 144 of adjacent punch pins 68 has the respective distal corners 126 spaced apart from one another. As used herein and in the appended claims, reference to the distal corners 126 being adjacent one another means that the distal corners 126 of two adjacent pins 68 are separated only by the gap between the two adjacent pins 68, while reference to the distal corners 126 being spaced apart from one another means that the distal corners of two adjacent pins 68 are separated by the gap between the two adjacent pins as well as by the width of the pins themselves.

As seen from FIG. 9, the first pair 140 and the second pair 144 overlap so as to be made up of three consecutive pins 68 (pin numbers 17, 15, and 13). The first and second pins make up the pair 140, while the second and third pins make up the second pair 144. In this manner, it can be seen that with the exception of the two outermost pins (pin numbers 1 and 2) and the central pin (pin number 5), the illustrated pins 68 follow the alternating pair arrangement in which consecutive adjacent pairs alternate between having the distal corners 126 adjacent one another and having the distal corners 126 spaced apart from one another. There are at least eight pairs of adjacent pins having the respective distal corners 126 adjacent to one another and there are at least nine pairs of adjacent pins having the respective distal corners 126 spaced apart from one another. This arrangement has been found to lower the peak punching force and smooth out the punch force profile. In other embodiments, such a consistent alternating pair arrangement need not be used, but instead, less than eight pairs of adjacent pins could have the respective distal corners 126 adjacent to one another and less than nine pairs of adjacent pins could have the respective distal corners 126 spaced apart from one another.

In alternative embodiments, one or more of the punch pins 68 can be selectively disengageable during the punch stroke. However, even in such instances, the selectively disengageable pins can have the attributes described above such that when engaged, the peak punch force and the smooth punch force profile are attained.

Figure 11:
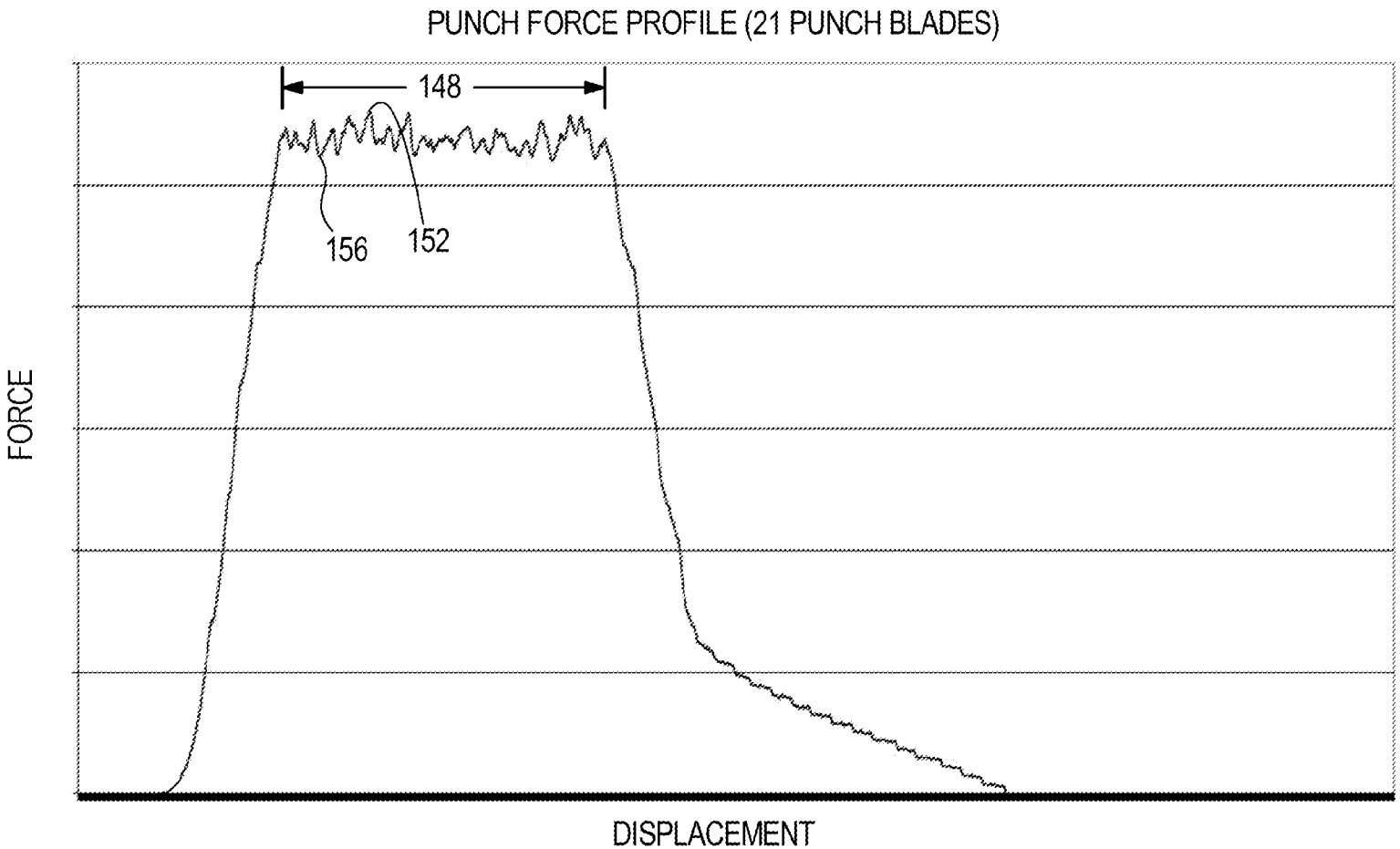
FIG. 11 is graph of punch force versus displacement for the binding machine of FIG. 3.

As discussed above, the arrangement of the planar surface 122 of each punch pin 68 and the arrangement of the plurality of punch pins 68 on the punch plate 80 all contribute to the smooth punch force profile achieved during the punch stroke. As used herein and in the appended claims, the terms "punch force profile" or "force profile" refer to the curve generated by plotting the punching force of the punch plate 80 versus the displacement of the punch plate 80 during the punch stroke. FIG. 11 illustrates such a graph of the punch force profile for the punch plate 80 of the invention, which was mathematically determined based on test data collected for a single punch pin 68. Alternatively, the graph can be created using test data collected for the entire punch plate 80, with all of the punch pins 68 in the arrangement shown in FIG. 9. Test data can be gathered by mounting a single punch pin 68 or the entire punch plate 80 in a test fixture with a mating die plate. Force and displacement data can be gathered as the pin 68 or punch plate 80 is driven through a punch stroke through a stack of sheets. This data can then be used to generate the punch force profile. Those skilled in the art will understand that there are also other methods that could be used to gather the data for the punch force profile, including providing sensors on the actual binding machine 40 to gather data for the punch force profile.

As seen from the graph in FIG. 11, the punch force initially increases to a first maximum or peak force value. After that initial maximum is reached, the punch force drops, presumably after some of the punch pins have pierced through the stack of sheets. After that, the punch force profile shows a series of increases and decreases in force as displacement of the punch plate 80 continues during the punch stroke, until the final maximum force or peak is achieved. Then, the force decreases to zero at the end of the punch stroke, with a slight variation from a mirror image due to the friction present as the punch pins 68 pass through the punched holes in the stack of sheets. This period from the first force drop to the last peak force value prior to the final decrease in force is designated as the portion 148 of the punch force profile. The smooth punch force profile provided by the plate 80 is defined by the low percentage change in force between the forces present in the portion 148. More specifically, "percent change in force" as used herein and in the appended claims is determined by the following calculation:

$$\%\ \text{Change} = \frac{(\text{Highest Normalized Force in Portion 148} - \text{Lowest Normalized Force in Portion 148})}{\text{Highest Normalized Force in Portion 148}}$$

Where the normalized force values are determined relative to a trend line plotted through the portion 148.

In FIG. 11, the trend line is substantially horizontal such that the normalized force values are the same as the actual force values. A calculation of percent change in force in portion 148 is taken using point 152 as the highest normalized force in portion 148 and the point 156 as the lowest normalized force in portion 148. The percent change in one embodiment is no more than 15 percent, in another embodiment is no more than 7.5 percent, and in the illustrated embodiment is about 7.4 percent. This low percent change in force in the portion 148 results in the smooth feel the user experiences when using the binding machine 40.

The punch plate 80 of the present invention provides both a low peak punching force value (i.e., up to 30 percent lower than prior art binding machines), as well as a smooth punch force profile in the portion 148 of the punch stroke. The total area under the curve in FIG. 11 is the energy required by the punch plate 80 to complete the punch stroke. Once the punch force profile is determined for the particular punch plate 80, the cams 76 can be designed to provide the appropriate mechanical advantage at the appropriate time during the lever 64 stroke to reduce the force input a user must provide to drive the punch plate 80, and hence the perceived peak punching force. To some extent, the design of the cams 76 can also further enhance the smooth feel provided to the user by the low percent change in force in portion 148 of the profile of the punch plate 80.

Figure 12:
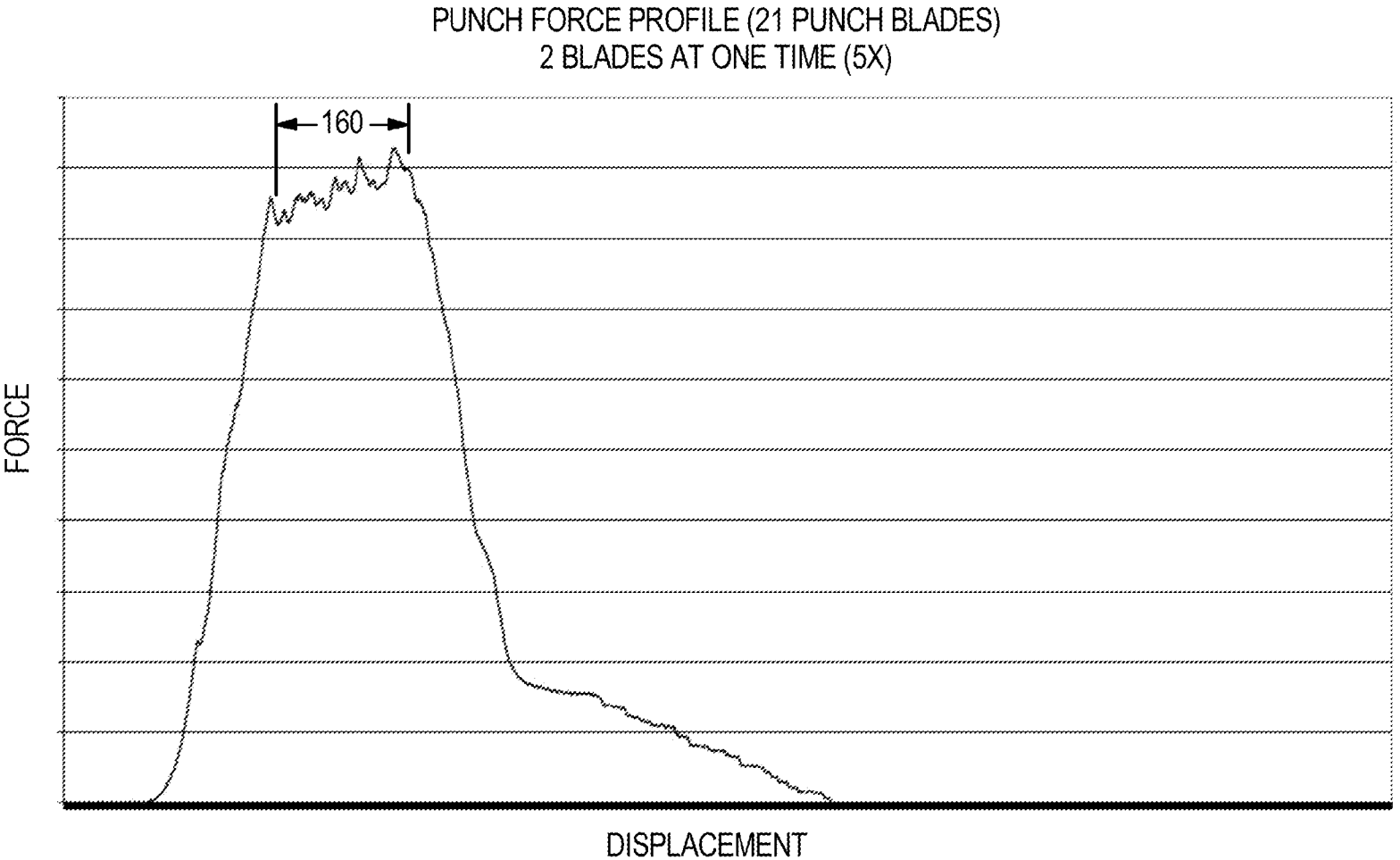
FIG. 12 is graph of punch force versus displacement for an alternative punching mechanism arrangement.
Figure 13:
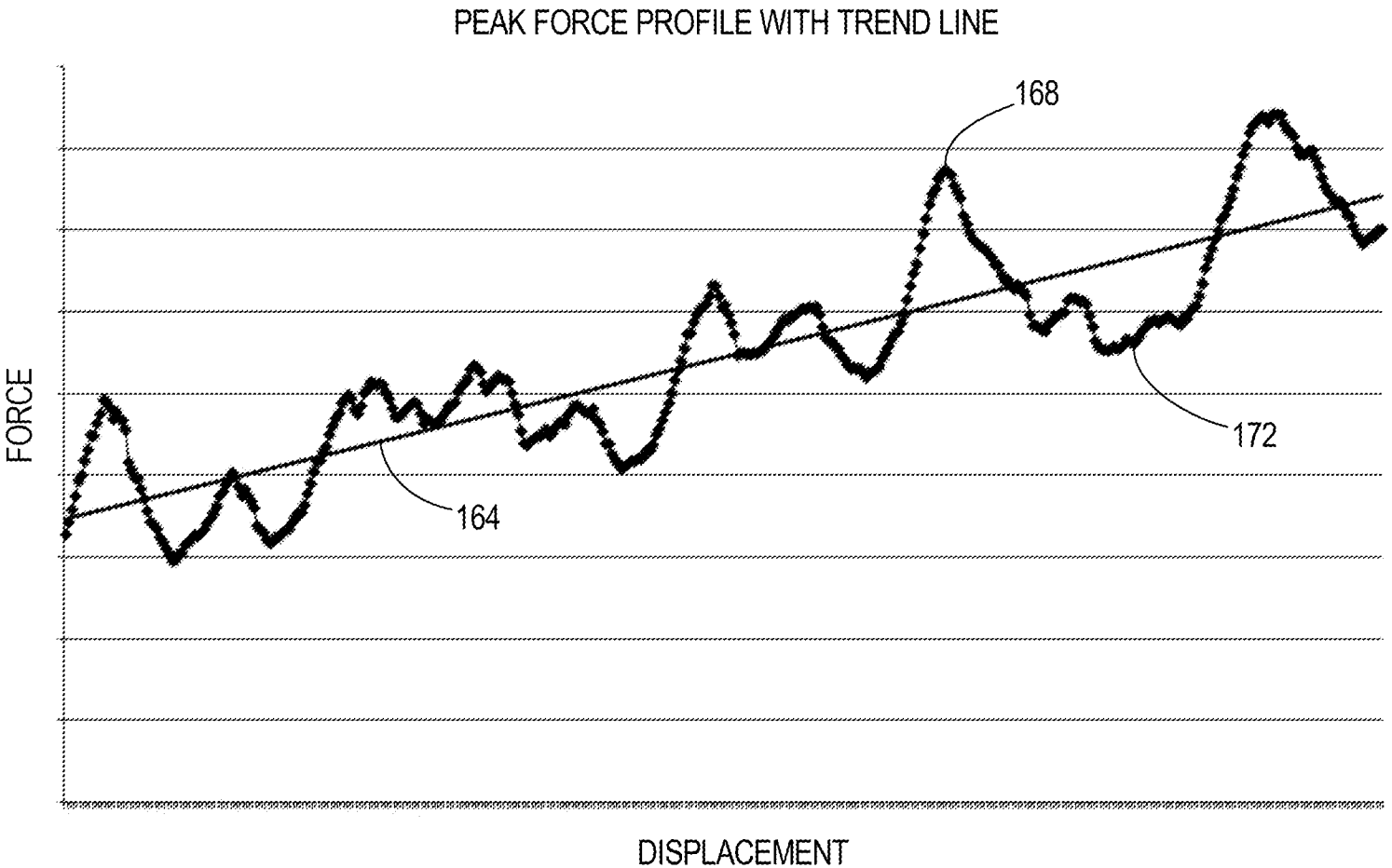
FIG. 13 is an enlarged portion of the graph of FIG. 12.

Various modifications can be made to the punch plate 80 while still achieving the smooth punch force profile that leads to the smooth, ergonomic feel for the user. For example, FIGS. 12 and 13 illustrate a graph of a punch force profile that has been generated mathematically based on data collected for the punch pin 68, but for a punch plate in which the punch pin phasing has been changed. In particular, instead of each of the punch pins having a different length, as measured to the respective distal ends, the profile in FIGS. 12 and 13 is representative of a punch plate having twenty-one punch pins with five pairs of pins that have the same length. In other words, at least 45 percent of the punch pins still have different lengths from all other pins. Alternatively, the graph can be created using test data collected for the modified punch plate, with all of the punch pins 68 in the modified arrangement.

In comparing with the graph of FIG. 11, it can be seen that the peak punch force is higher in FIGS. 12 and 13, which is expected due to the fact that five pairs of punch pins are contacting and piercing the stack of sheets at the same time. However, as also expected, the portion 160, defined from the first force drop to the last peak force value prior to the final decrease in force, is shorter relative to the amount of displacement that occurs because of the five pairs of pins with the same lengths.

FIG. 13 is an enlarged view of the portion 160 in FIG. 12. In contrast to the flat trend line observed in FIG. 11, FIG. 13 illustrates that the portion 160 has an increasing trend line 164, which is used as the basis for selecting the highest and lowest normalized force values (i.e., selected based on distance away from the trend line 164). The percent difference in force for the portion 160 is calculated using the point 168 as the highest normalized force and the point 172 as the lowest normalized force in the portion 160. This calculation reveals a percent difference in force of about 5.4 percent, which again is both lower than the 15 percent and the 7.5 percent values desired to achieve a smooth force profile in the portion 160.

By comparing the graphs in FIGS. 11 and 12, it can be understood that modifications made to the punch plate 80, and specifically to the pins 68, can be used to optimize the binding machine to desired characteristics. While the punch plate 80 shown in FIG. 9 results in a lower peak punch force (see FIG. 11) than the hypothetical modified punch plate represented by the punch force profile of FIG. 12, it does have a slightly higher percent difference in the portion 148 than calculated for the portion 160, and therefore may provide a slightly rougher feel to the user. One skilled in the art will understand that modifications made to the distal ends of the pins 68 and to the length, orientation, and positioning of the pins 68 on the punch plate 80 can also result in different punch force profiles that can be optimized for a specific binding machine application. Once the particular punch plate design is selected, and its punch force profile analyzed, the cams 76 can be designed to accommodate the particular punch force profile so that the mechanical advantage is provided as needed during rotation of the lever 64 to reduce the input force required from the user. Different cam designs can be used for different punch plate configurations.

Various features of the invention are set forth in the following claims.

What is claimed is:

1. A binding machine comprising:

a body including a working deck on which a user binds a stack of sheets;

an actuator coupled with the body; and a punch mechanism housed in the body for punching a stack of sheets upon actuation of the actuator, the punch mechanism including a plate including a plurality of punch pins, wherein four of the pins define longest pins of the plurality of punch pins, each of the four longest pins having different lengths from one another and being positioned in two pairs, one pair defining outermost and second outermost pins at one end of the plate, and one pair defining outermost and second outermost pins at another end of the plate, and wherein a fifth longest pin of the plurality of punch pins, which is shorter than the four longest pins, defines the middle pin of the plate.

2. The binding machine of claim 1, wherein each of the plurality of punch pins is integrally formed with the plate.

3. The binding machine of claim 1, wherein at least 45 percent of the plurality of punch pins have different lengths from each other.

4. The binding machine of claim 3, wherein each of the plurality of punch pins has a different length such that each of the plurality of punch pins engages the stack of sheets at a different time during the punch stroke.

5. The binding machine of claim 1, wherein each of the plurality of punch pins includes a pair of parallel sides and a distal end defining a planar surface that is oblique to the pair of sides.

6. The binding machine of claim 5, wherein the planar surface includes four corners, each corner lying in a different plane perpendicular to a punching direction such that no two corners of the surface engage the stack of sheets at the same time during punching.

7. The binding machine of claim 1, wherein each punch pin includes a distal corner that is the first portion of the punch pin to engage the stack of sheets during punching, the punch pins positioned on the plate such that a first pair of adjacent punch pins has the respective distal corners adjacent to one another and a second pair of adjacent punch pins has the respective distal corners spaced apart from one another.

8. The binding machine of claim 7, wherein the plate includes first, second, and third consecutively-positioned punch pins, the first and second of the consecutively-positioned punch pins defining the first pair of adjacent punch pins and the second and third of the consecutively-positioned punch pins defining the second pair of adjacent punch pins.

9. The binding machine of claim 7, wherein there are at least eight pairs of adjacent punch pins having the respective distal corners adjacent to one another, and there are at least 9 pairs of adjacent punch pins having the respective distal corners spaced apart from one another.

10. The binding machine of claim 1, further comprising:

a shaft coupled with the actuator such that movement of the actuator causes rotation of the shaft; and at least one cam mounted on the shaft for rotation therewith, the cam coupled with the plate to drive the plate in a punching direction, the cam including a cam profile that dictates displacement of the plate in the punching direction relative to rotation of the shaft.

11. The binding machine of claim 10, wherein the cam profile is such that a force vector at an interface between the cam and the plate is always within 5 degrees of the punching direction during motion of the plate in the punching direction.

12. The binding machine of claim 10, further comprising a non-metallic material positioned between the cam and the plate.

13. The binding machine of claim 10, wherein the cam profile is a first cam profile for driving the plate in the punching direction, and wherein the cam includes a second cam profile for returning the plate in a direction opposite to the punching direction.

14. The binding machine of claim 1, wherein the punch pins are configured to punch through the stack of sheets during a punch stroke, the punch stroke defining a force profile of a force on the plate versus a displacement of the plate during the punch stroke, a portion of the force profile, defined from a first drop in force to a last peak force before a final decrease, having no more than a 15 percent change in force relative to a normalized maximum force of the force profile.

15. The binding machine of claim 14, wherein the portion of the force profile has no more than a 7.5 percent change in force relative to the normalized maximum force of the force profile.

16. The binding machine of claim 1, wherein each of the plurality of punch pins has a different length such that each of the plurality of punch pins engages the stack of sheets at a different time during the punch stroke, and wherein no two pins of consecutive length are positioned adjacent one another on the plate.

17. The binding machine of claim 16, wherein each punch pin includes a distal corner that is the first portion of the punch pin to engage the stack of sheets during punching, the punch pins positioned on the plate such that a first pair of adjacent punch pins has the respective distal corners adjacent to one another and a second pair of adjacent punch pins has the respective distal corners spaced apart from one another.

18. The binding machine of claim 17, wherein the plate includes first, second, and third consecutively-positioned punch pins, the first and second punch pins defining the first pair of adjacent punch pins and the second and third punch pins defining the second pair of adjacent punch pins.

19. The binding machine of claim 17, wherein there are at least eight pairs of adjacent punch pins having the respective distal corners adjacent to one another, and there are at least 9 pairs of adjacent punch pins having the respective distal corners spaced apart from one another.

20. The binding machine of claim 17, wherein each of the plurality of punch pins includes a pair of parallel sides and a distal end defining a planar surface that is oblique to the pair of sides.

21. The binding machine of claim 20, wherein the planar surface includes four corners, each corner lying in a different plane perpendicular to a punching direction such that no two corners of the surface engage the stack of sheets at the same time during punching.

* * * * *